United States Patent [19]

Osborne

[11] Patent Number: 4,504,050

[45] Date of Patent: Mar. 12, 1985

[54] HEAD SUPPORT

[75] Inventor: Dennis R. S. Osborne, Chapel Hill, N.C.

[73] Assignee: Duke University, Durham, N.C.

[21] Appl. No.: 428,969

[22] Filed: Sep. 30, 1982

[51] Int. Cl.[3] ..... A61G 13/00

[52] U.S. Cl. ..... 269/328; 378/179; 378/180; 5/435

[58] Field of Search ..... 269/328, 322, 323, 79; 378/179, 180, 208; 5/434, 435, 436, 437, 440; 108/1, 4; 248/118, 371

[56] References Cited

U.S. PATENT DOCUMENTS

| | | | |
|---|---|---|---|
| 1,246,981 | 11/1917 | Moyer | 248/371 X |
| 1,677,049 | 7/1928 | Proctor . | |
| 2,507,172 | 5/1950 | Naclerio . | |
| 2,509,086 | 5/1950 | Eaton | 269/328 |
| 2,684,064 | 7/1954 | Thompson | 269/328 X |
| 2,715,557 | 8/1955 | Rock . | |
| 3,319,954 | 5/1967 | Shevick et al. . | |
| 3,337,883 | 8/1967 | Allison | 5/435 |
| 3,851,644 | 12/1974 | Slagle . | |
| 3,957,262 | 5/1976 | McReynolds . | |
| 4,045,678 | 8/1977 | Rickard | 269/328 X |

*Primary Examiner*—Robert C. Watson
*Assistant Examiner*—Steven P. Schad
*Attorney, Agent, or Firm*—Oblon, Fisher, Spivak, McClelland & Maier

[57] ABSTRACT

A head support for examination of a subject who is oriented in a prone position on a platform which includes a base positioned on the platform, at least one flange extending from the base, a faceplate connected to the flange defining a support for cooperating with the face of the subject such that a forehead portion of the subject is supported at a first end portion of the faceplate and a chin portion of the subject is supported at a second end portion of the faceplate while the subject is in the prone position and a mechanism for adjusting the position of the faceplate with respect to the flange and for controlling the degree of extension of the subject which is necessary for performing the examination of the subject.

9 Claims, 3 Drawing Figures

HEAD SUPPORT

BACKGROUND OF THE INVENTION

1. Field of the Invention

This invention relates to a head support and, more particularly, a head support which is utilized in connection with medical examinations.

2. Description of the Prior Art

It is known that the prone position is essential for most positive contrast myelographic examinations. To control and distribute contrast agent cervical and thoracic regions carefully monitored head extension is required. However, a controlled prone head extended position can be uncomfortable for patients and occasionally compromises the airway. These factors have been found to limit patient cooperation and correspondingly complicate the examination when the patient is head down.

Head supports are known in the art such as those disclosed in U.S. Pat. No. 2,507,172; U.S. Pat. No. 3,957,262; and U.S. Pat. No. 3,319,954. In U.S. Pat. No. 2,507,172, a surgical support for patients oriented in a face-down position is noted but such structure is clearly quite complex and expensive to manufacture despite the fact that it allows for the patient to be oriented in a facedown position. U.S. Pat. No. 3,957,262 discloses a device for supporting and immobilizing a patient's head during surgery or examination by a treating physician. The device includes a headpiece adapted to receive and approximate the contour of the patient's head and includes means for securing the headpiece to one or more support members. The support members have upper ends for steadying a portion of the treating physician's upper limb and lower or base ends mounted to a surface for supporting the patient's body. It is to be noted, however, that this device does not provide for support of a patient in a facedown position which has been found to be necessary in the situations noted above. U.S. Pat. No. 3,319,954 also discloses a surgical head holder which includes a base, a bracket, a headrest having head-supporting surfaces defining a seat to locate the head of the subject relative to the headrest with the top of the head at one end region of the headrest and the neck at the other end region of the headrest, a mechanism for pivotally mounting the headrest on the bracket for movement about a first axis fixed with respect to the headrest and the bracket, the axis extending longitudinally of the headrest to pass longitudinally through the head and neck of the subject, and a mechanism for pivotally mounting the bracket on the base for movement about a second axis fixed with respect to the bracket and the base, the second axis extending transverse to the first axis to extend transversely of the seat as well as transversely through the neck of the subject. It is again to be noted, however, that the head holder does not clearly lend itself to the support of the head of a patient in a head-down position so as to allow for prone hyperextension or prone extension of the head of the patient. The known prior art also includes a headrest produced by the M-G Equipment Company of St. Paul, Minn. This headrest, designed for radiotherapy, is, however, unsuitable for myelography and CT insofar as it is unstable and does not allow for controlled variable hyperextension.

SUMMARY OF THE INVENTION

It is therefore an object of the present invention to provide a head support which allows for control of the degree of hyperextension necessary to perform myelographic examinations as well as other examinations with the patient prone, comfortable, with a good airway and with easy operator access.

Another object of the present invention is to provide a head support which allows for control and distribution of a contrast agent in the cervical and thoracic regions by allowing careful monitoring of head extension.

A further object of the present invention is to provide a head support which is radioluscent so as not to interfere with radiographic technique.

In accordance with the present invention, a head support is utilized for examination of a subject who is oriented in a prone position on a platform which includes a base positioned on the platform, at least one flange upwardly extending from the base, a faceplate connected to the flange defining a support for cooperating with the face of a subject such that the forehead of the subject is supported at a first end portion of the faceplate and a chin portion of the subject is supported at a second end portion of the faceplate while the subject is in the prone position and a mechanism for adjusting the position of the faceplate with respect to the flange and for controlling the degree of extension of the subject which is necessary to perform the examination of the subject.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
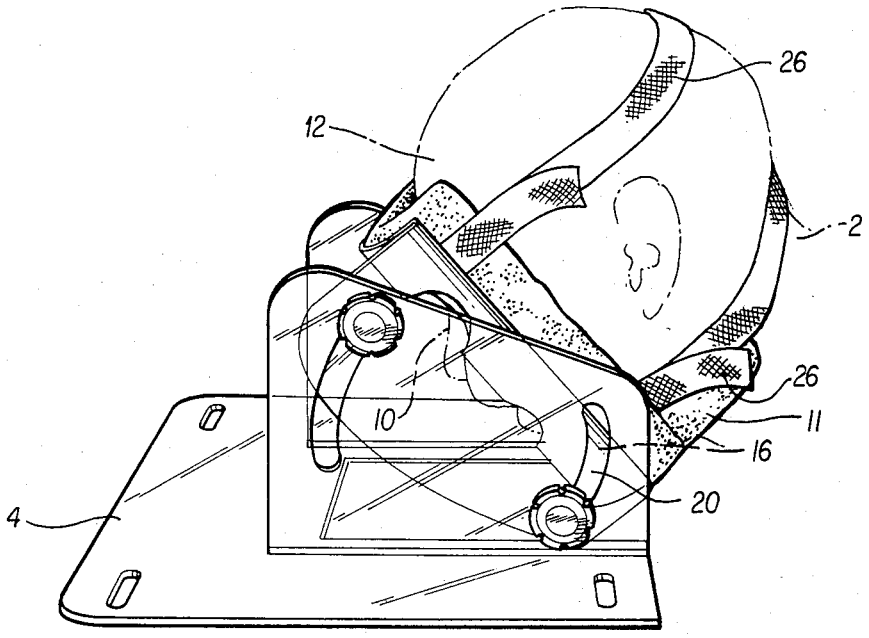
FIG. 1 is a side perspective view of the present invention.
Figure 2:
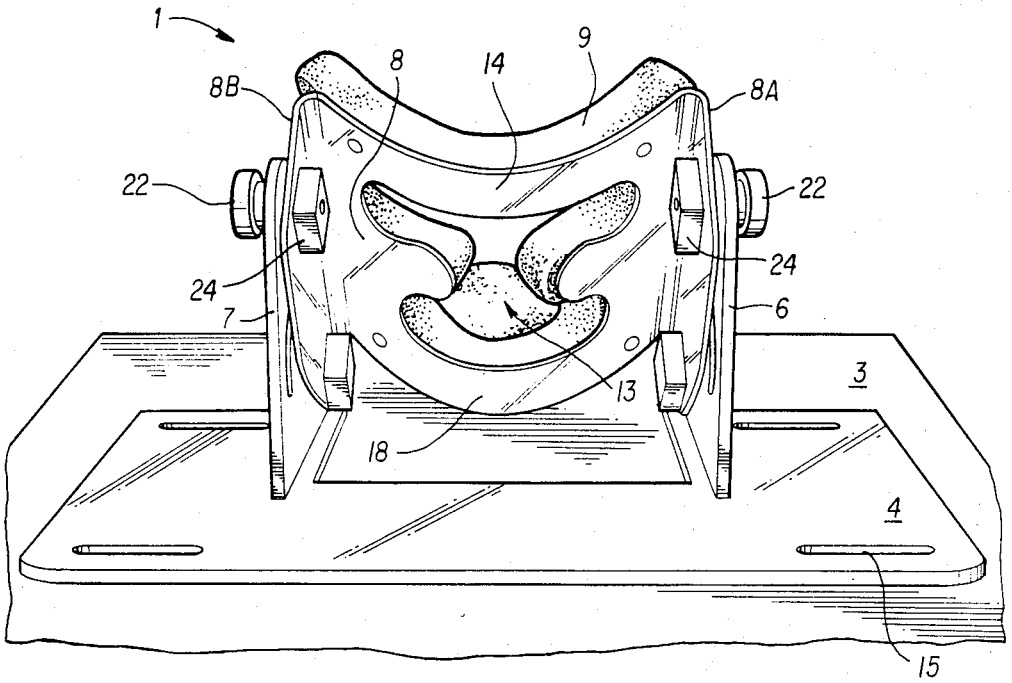
FIG. 2 is a front elevational view of the device shown in FIG. 1.
Figure 3:
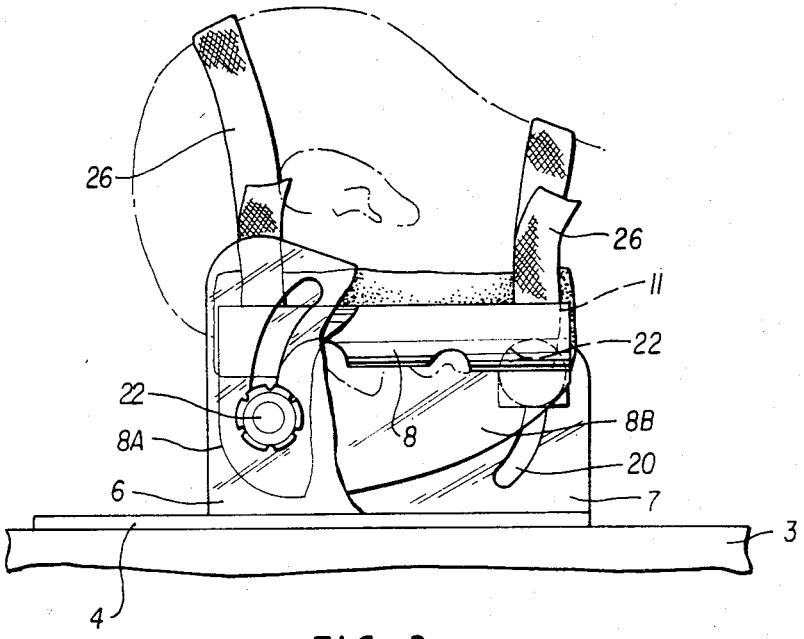
FIG. 3 is a side view partly in section of the device shown in FIG. 1.

As shown in FIGS. 1–3, a head support 1 is provided for examination of a subject 2 who is oriented in a prone position on a platform 3. Mounted on the platform is a base 4 which has at least one flange 6, 7 extending upwardly therefrom.

A faceplate 8 is connected to each of the flanges 6, 7 so as to define a support for cooperating with the face 10 of the subject 2 such that a forehead portion 12 of the subject 2 is supported at a first end portion 14 of the faceplate 8 and a chin portion 16 of the subject 2 is supported at a second end portion 18 of faceplate 8 while the subject 2 is in a prone position.

A mechanism is also provided for adjusting the position of faceplate 8 with respect to flanges 6, 7 and for controlling the degree of extension of the subject which is necessary to perform examination of the subject. This mechanism includes wing screw 22 and wing nut 24 in combination with slots 20, 20 formed in flanges 6, 7. The head support is made of a radioluscent material so as to not interfere with radiographic techniques.

Faceplate 8 is a substantially U-shaped plate and includes a first and second support member 8A, 8B extending downwardly therefrom which are operatively connected to flanges 6, 7, respectively. Adjustment of the position of the faceplate 8 with respect to flanges 6, 7 is accomplished by loosening the wing screws 22 and wing nut 24 so as to allow for adjustment of the angular position of faceplate 8 with respect to flanges 6, 7 as shown in the figures so as to provide for prone hyperextension or prone extension of the head of the subject 2. Upon obtaining the proper position of the subject's head, the wing screw 22 is tightened with respect to wing nut 24 so that examination can then begin. Velcro straps 26 or similar securing members can also be utilized by being connected to faceplate 8 or, alternatively, flanges 6, 7 for controlling the position of the head of the subject 2.

Additional control of the position of the head of the subject 2 with respect to the faceplate is obtained by providing a chin support 11 which is adjacent second end portion 18 for supporting a lower end portion of the chin of the subject 2. The faceplate 8 is also provided with an opening 13 for receiving the face 10 of the subject. The face 10 of the subject 2 is comfortably positioned in faceplate 8 by the use of a pad 9 which lines the upper side of faceplate 8.

It is possible to maintain adequate traction between the base 4 and the platform 3 in normal operation but slots 15 can also be provided within base 4.

In operation, the head support 1 is placed on platform 3 so that base 4 has adequate traction with respect to platform 3. The wing screw 22 and wing nut 24 on either or both flanges 6, 7 can then be loosened so as to allow for positioning of the face 10 of the subject with an opening 13 in the faceplate 8. The proper degree of extension of the head of the subject 2 is thereby obtained and, if necessary, the straps 26 can be properly secured about the head of the subject 2. Once the proper positioning of the head of the subject 2 is obtained, the wing screw 22 and wing nut 24 are tightened so that the necessary operation can be performed. The device of this invention also allows for easy adjustment of the degree of extension of the head of the subject 2 by loosening one or more of the wing screws 22 and wing nuts 24 so as to allow for angular adjustment of the faceplate 8.

It can therefore be appreciated that the head support of the present invention allows for the utilization of a prone position in various examinations such, for example, positive contrast myelographic examinations. Correspondingly, proper control and distribution of a contrast agent in the cervical and thoracic regions is possible based upon careful monitoring of head extension of the subject 2. A comfortable, controlled prone head extended position can therefore be obtained which does not compromise the airway of the subject 2 and which therefore maximizes the cooperation of the patient and simplifies the examination of the subject in a headdown position. It is also thus possible to adjust the degree of head extension during a study to effect an appropriate distribution of contrast agent. It can therefore be appreciated that, for example, the head support can be used for prone head support for myelography, computed tomography, and for prone neurosurgical procedures, e.g. percutaneous cordotomies.

Obviously, numerous modifications and variations of the present invention are possible in light of the above teachings. It is therefore to be understood that within the scope of the appended claims, the invention may be practiced otherwise than as specifically described herein.

What is claimed as new and is intended to be secured by Letters Patent is:

1. A head support for examination of a subject who is oriented in a prone position on a platform, comprising:

a base positioned on said platform;

at least one flange extending from said base;

a faceplate connected to said flange defining a support for cooperating with the face of said subject such that a forehead portion of said subject is supported at a first end portion of said faceplate and a chin portion of said subject is supported at a second end portion of said faceplate while said subject is in said prone position; and means for rotatably adjusting said faceplate with respect to each said flange and for controlling the degree of extension of said subject which is necessary for performing said examination of said subject wherein said at least one said flange further comprises a first and second flange located on opposing sides of said faceplate, said first and second flange each has a first and second arcuate slot formed therein and wherein said means for rotatably adjusting said faceplate with respect to each said flange further comprises adjustable securing means disposed within each said first and second arcuate slot for selectively interconnecting and positioning said faceplate with respect to said first and second flanges.

2. A head support as set forth in claim 1, wherein said head support further comprises a radioluscent material.

3. A head support as set forth in claim 1, further comprising means connected to said faceplate for controlling the position of the head of subject.

4. A head support as set forth in claim 3, wherein said means for controlling the position of the head further comprises strap means connected to said faceplate.

5. A head support as set forth in claim 1, wherein said at least one slot further comprises a first and second slot.

6. A head support as set forth in claim 1, further comprising a support mounted on said faceplate adjacent said second end portion for supporting a lower end portion of the chin of said subject.

7. A head support as set forth in claim 1, wherein said faceplate has an opening formed therein for receiving the face of said subject.

8. A head support as set forth in claim 1, wherein said faceplate is substantially U-shaped and further comprises at least one support member extending therefrom operatively connected to said at least one flange.

9. A head support as set forth in claim 8, wherein said at least one support member further comprises a first and second support member extending from opposite sides of said faceplate.

* * * * *